US005379995A

United States Patent [19]

Endo

[11] Patent Number: 5,379,995

[45] Date of Patent: Jan. 10, 1995

[54] SHEET FEED DEVICE FOR AN IMAGE RECORDER

[75] Inventor: Kenji Endo, Fukushima, Japan

[73] Assignee: Ricoh Company, Ltd., Tokyo, Japan

[21] Appl. No.: 124,007

[22] Filed: Sep. 21, 1993

Related U.S. Application Data

[63] Continuation-in-part of Ser. No. 998,686, Dec. 30, 1992, abandoned.

[30] Foreign Application Priority Data

Jan. 10, 1992 [JP] Japan ..... 4-2529
Dec. 3, 1992 [JP] Japan ..... 4-324409

[51] Int. Cl.[6] ..... B65H 3/44
[52] U.S. Cl. ..... 271/9; 271/164
[58] Field of Search ..... 271/9, 162, 164, 241, 271/157, 117, 126

[56] References Cited

U.S. PATENT DOCUMENTS 5,253,015 10/1993 Morita et al. ..... 271/164 X

FOREIGN PATENT DOCUMENTS 0398659 11/1990 European Pat. Off. ..... 271/9
388631 4/1991 Japan ..... 271/9

*Primary Examiner*—David H. Bollinger
*Attorney, Agent, or Firm*—Oblon, Spivak, McClelland, Maier & Neustadt

[57] ABSTRACT

A sheet feed device for feeding a sheet to a printer or similar image recorder which records an image on the sheet. A table is disposed below and operatively connected to the image recorder. A plurality of trays are received in the table, and each is loaded with a stack of sheets. The trays each has a base disposed in the tray and an elevation plate elevatably mounted on the base. A sheet feed mechanism feeds the sheets from a desired one of the trays to the image recorder. A drive mechanism is associated with each of the trays for moving the base in a predetermined direction over a predetermined distance within the tray. When the sheet is deviated in position from an image to be recorded, the device automatically corrects the deviation within a short period of time.

11 Claims, 6 Drawing Sheets

SHEET FEED DEVICE FOR AN IMAGE RECORDER

The present application is a continuation-in-part of U.S. patent application Ser. No. 07/988,686, filed Dec. 30, 1992, now abandoned.

BACKGROUND OF THE INVENTION

1. Field of the Invention

The present invention relates to a sheet feed device for a printer, copier, or similar image recorder of the type recording images on sheets.

2. Description of the Related Art

Generally an image recorder of the type described is provided with a sheet feed device for feeding sheets to which images are to be transferred from an image carrier. For example, a printer using a stencil or master has a print drum for wrapping a stencil therearound, and a press roller pressed against the print drum. In this case, the sheet feed device feeds a sheet to between the print drum and the press roller, allowing an image cut into the stencil to be transferred to the sheet. The sheet feed device has a bottom plate on which the sheets are stacked. Usually, the bottom plate protrudes sideways from the printer to the outside. This kind of configuration undesirably increases the overall size of the printer and, therefore, needs a large space for installation.

The sheet fed from the bottom plate of the sheet feed device is often deviated from the image cut in the stencil at a printing position. It is therefore a common practice to change the sheet feed timing if the deviation is in the front-and-rear direction or to move the bottom plate in the right-and-left direction by operating a knob if the deviation is in the right-and-left direction. However, moving the bottom plate by hand while observing the displacement by eye is time-consuming and, moreover, does not permit accurate and delicate adjustment. Furthermore, if movement of the bottom plate in the right-and-left direction is carried out during periods of time when the sheet is fed or the sheets are separated at a separating portion, a part of the sheet is fixed by a pick-up roller or a transfer roller while the other part of the sheet is forced to be moved by the bottom plate. As a result, the sheet may be skewed, torn or wrinkled.

SUMMARY OF THE INVENTION

It is, therefore, an object of the present invention to provide a sheet feed device for a copier, printer or similar image recorder which needs a minimum of space for installation.

It is another object of the present invention to provide a sheet feed device for a copier, printer or similar image recorder which automatically corrects a deviation in the position of a sheet from an image to be recorded within a short period of time.

A sheet feed device for feeding an image recorder which records an image on the sheet according to the present invention has a table disposed below, and operatively connected to, the image recorder, and a plurality of trays, each being received in the table and loaded with a stack of sheets. The trays each includes a base disposed in the tray and an elevation plate is elevatably mounted on the base. A sheet feed mechanism feeds the sheets from any one of the trays to the image recorder. A drive mechanism is associated with each of the trays for moving the base in a predetermined direction over a predetermined distance within the tray.

It is a further object of the present invention to provide a sheet feed device for a copier, printer or similar image recorder which prevents the sheet from skewing, tearing or wrinkling.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 2:
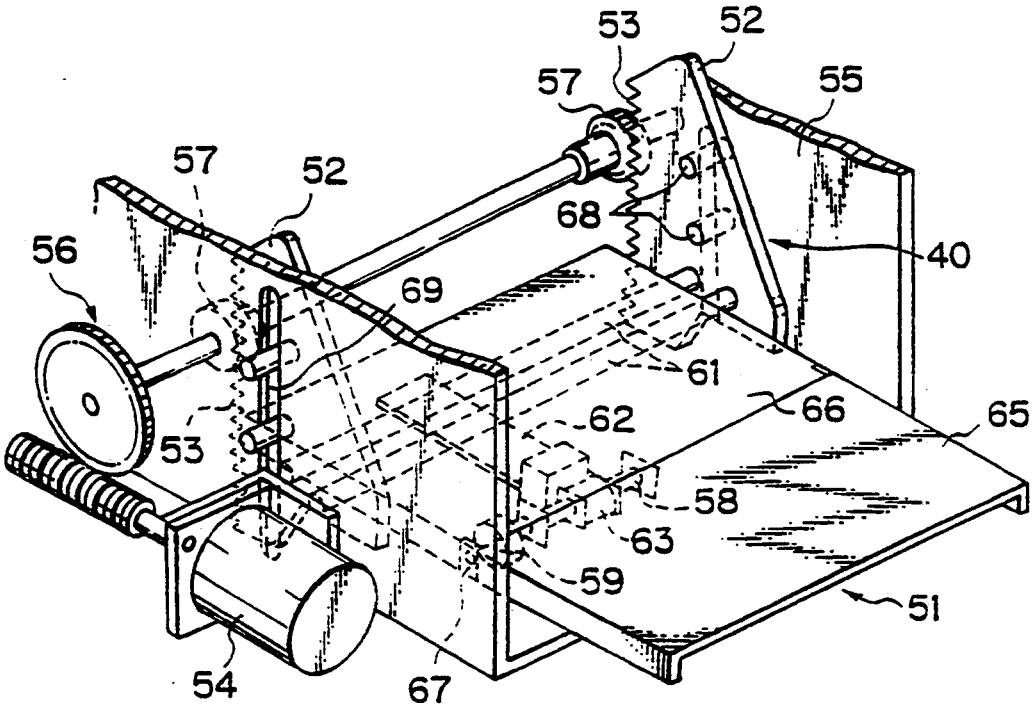
Fig. 2 PRIOR ART
FIGS. 2 and 3 are fragmentary perspective views showing the conventional sheet feed device.
Figure 3:
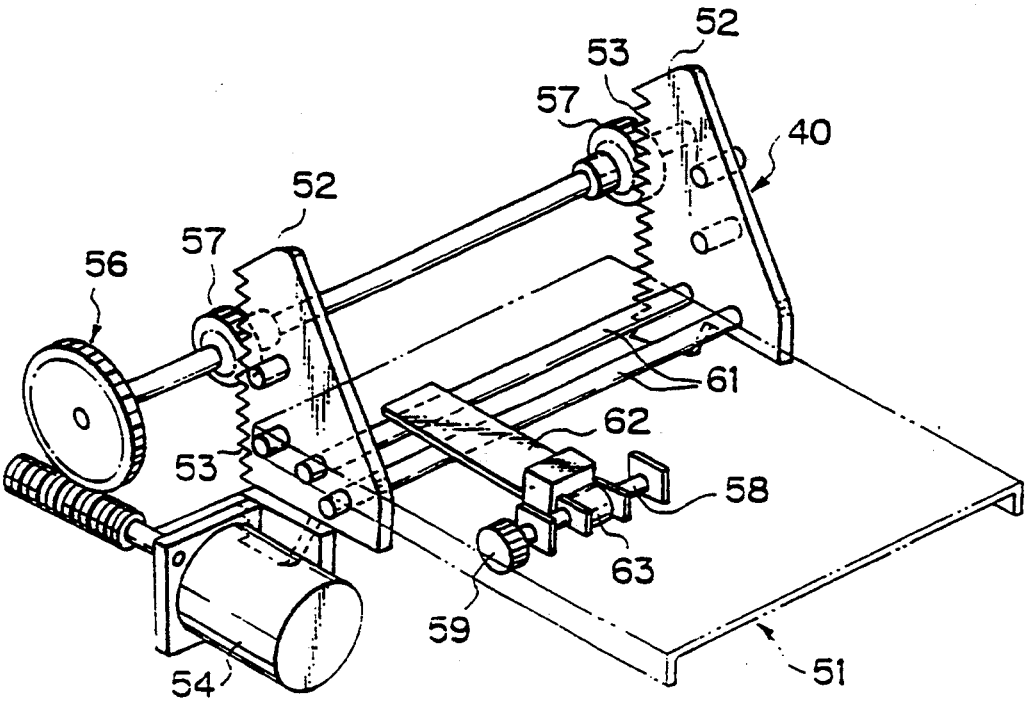
Fig. 3 PRIOR ART

To better understand the present invention, a brief reference will be made to a printer using a stencil and incorporating a conventional sheet feed device, shown in FIG. 1. As shown, the sheet feed device, generally 40, partly protrudes from one side of the printer 1. As shown in FIGS. 2 and 3 specifically, the sheet feed device 40 has a bottom plate 51 made up of a front half 65 and a rear half 66. The front half 65 is hinged to the rear half 66 by the shaft 67 so as to be movable to an upright position indicated by a phantom line in FIG. 1. Racks 52 are affixed to opposite rear side edges of the bottom plate 51, and each is formed with teeth 53 at the rear edge thereof. Pinions 57 are each mounted on one of opposite printer side walls 55 and held in mesh with one of the racks 52. An elevation motor 54 drives the pinions 57 via a worm gear train 56. A pair of guide shafts 68 extend out from each rack 52 and are received in a vertically extending slot 69 formed in associated one of the side walls 55. A threaded shaft 58 is rotatably mounted on the underside of the bottom plate 51. A knob 59 is affixed to one end of the threaded shaft 58 and has an upper portion exposed to the outside via an opening portion through the bottom plate 51. A pair of parallel rack stays 61 extend between the racks 52. A bracket 62 is mounted on the rack stays 61 and extends along the underside of the bottom plate 51 in the front-and-rear direction. A nut 63 is affixed to the end of the bracket 62 and is engaged with the threaded shaft 58.

Figure 1:
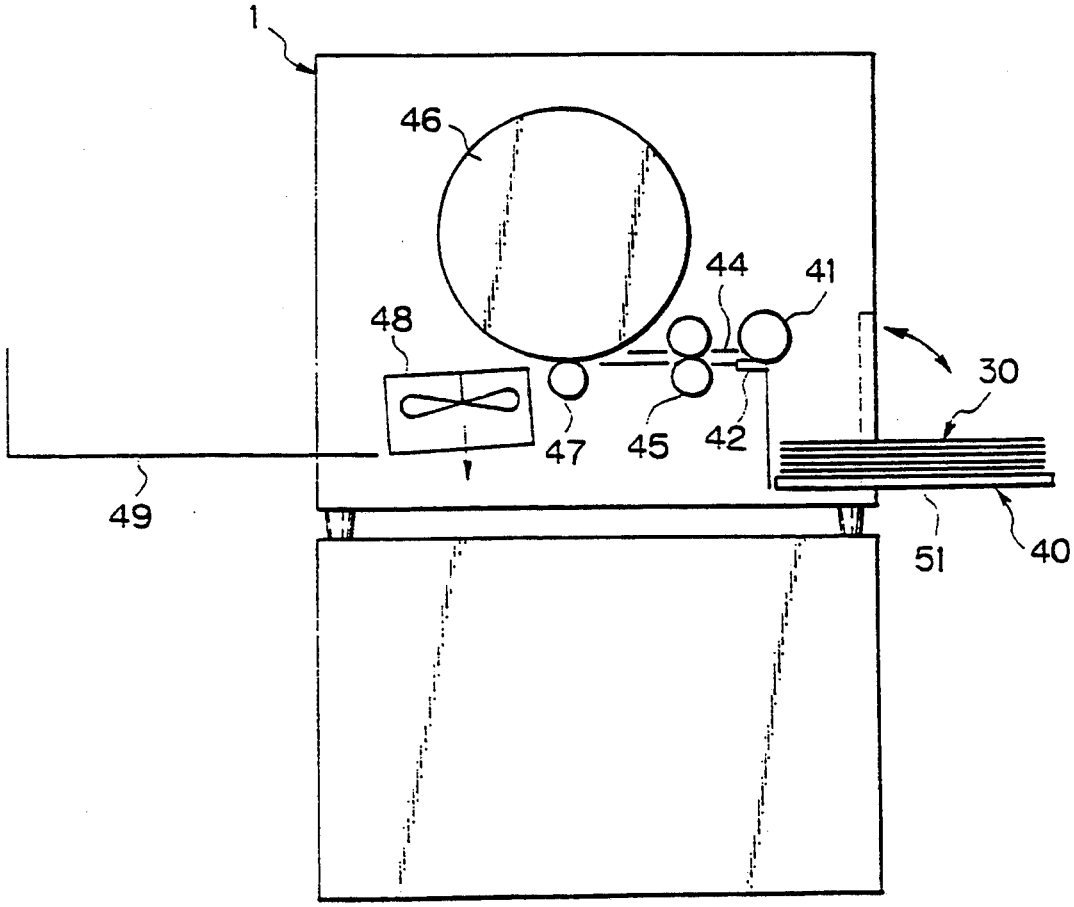
Fig. 1 PRIOR ART
FIG. 1 is a sectional side elevation of a printer using a stencil and having a conventional sheet feed device.

In operation, sheets 30 are stacked on the bottom plate 51 which is held in the solid line position of FIG. 1. As a start key provided on an operation panel (not shown) is pressed, the elevation motor 54 is energized to rotate the pinions 57, with the result that the bottom plate 51 is raised by the pinions 57 and the teeth 53 of the racks 52. The elevation of the bottom plate 51 is stopped when the top of the sheet stack 30 abuts against a pick-up roller 41 with an adequate pressure. Then, the pick-up roller 41 feeds the sheets 30 while a separating section 42 separates one of the sheets 30 from the others. A transport roller, not shown, transports the separated sheet 30 to a register roller 45 over a transport path 44. The register roller 45 first stops the movement of the sheet 30 and then drives it toward a print drum 46 with a predetermined timing. A cut stencil or master is wrapped around the print drum 46. As a pressure roller 47 presses the sheet 30 against the drum 46 via the stencil, an image is transferred from the stencil to the sheet 30. A suction unit 48 separates the sheet 30 with the image from the drum 46 and then discharges the sheet 30 onto a tray 49 while stressing it for a positioning purpose.

In the above printer, once a stencil is wrapped around the print drum 46, it cannot be changed in position. Hence, a deviation of the sheet 30 from the image cut in the stencil is corrected as follows. When the sheet 30 is deviated from the image in the front-and-rear direction with respect to the direction of sheet feed from the bottom plate 51, the time for feeding the sheet 30 is changed. For a deviation in the right-and-left direction perpendicular to the front-and-rear direction, the operator holds the knob 59 and rotates the same, while watching the displacement, so as to move the bottom plate 51 to the right or the left via the shaft 58 which is engaged with the nut 63 affixed to the bracket 62. When the bottom plate 51 is empty of the sheets 30 after the printing operation, the front half 65 of the bottom plate 51 is raised from the solid line position of FIG. 1 to the phantom line position so as not to constitute an obstruction.

The conventional sheet feed device 40 has some problems left unsolved, as follows. Since the device 40, i.e., the bottom plate 51 thereof, partly protrudes sideways from the printer 1, it makes the overall printer bulky and, therefore, aggravates the space requirement. Further, moving the bottom plate 51 in the right-and-left direction by operating the knob 59 by hand is time-consuming. Moreover, since such a movement of the bottom plate 51 relies on eyesight, it lacks accuracy and precision. Furthermore, if an operator moves the base in the right-and-left direction during periods of time when the sheet 30 is fed, or one of the sheets 30 is separated at the separating portion, some part of the sheet 30 is fixed by the pick-up 41 roller or the transfer roller, etc., and at the same time another part of the sheet 30 is forced to be moved by the bottom plate 51. As a result, the sheet 30 is stressed and, therefore, skewing, tearing or wrinkling occurs.

Figure 4:
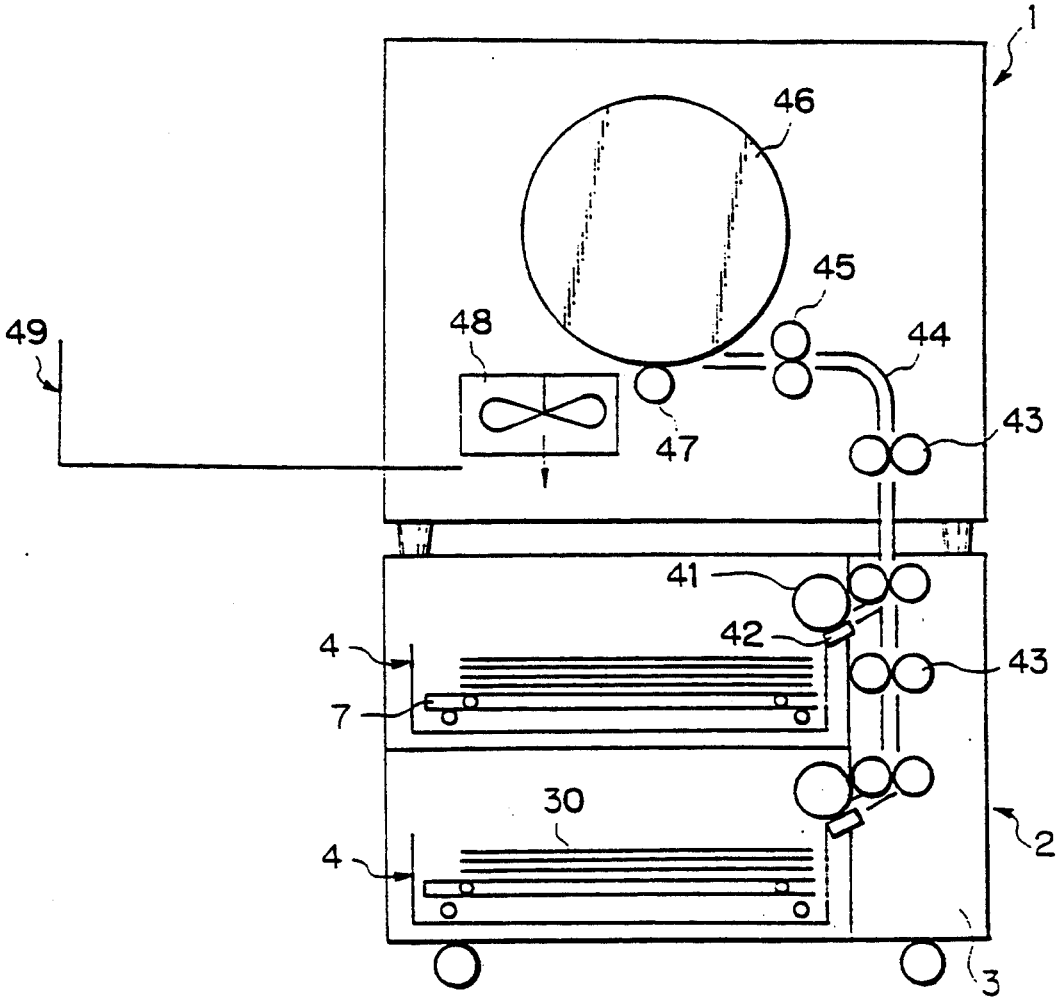
FIG. 4 is a sectional side elevation of a sheet feed device embodying the present invention and a printer operable with the sheet feed device.
Figure 5:
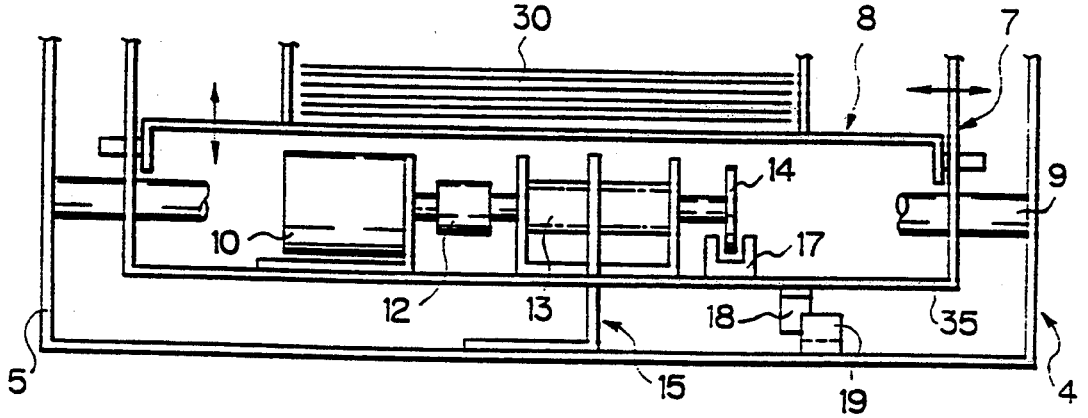
FIGS. 5 and 6 show a side elevation and a perspective view, respectively, of a tray included in the embodiment.
Figure 6:
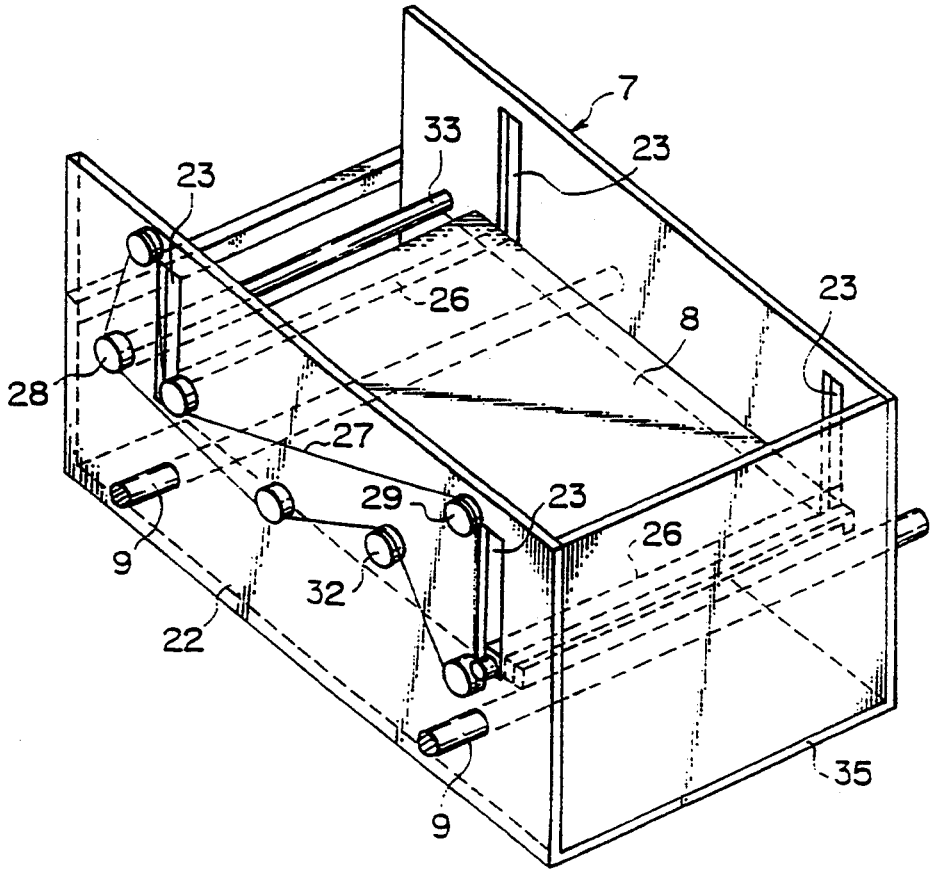
Figure 7:
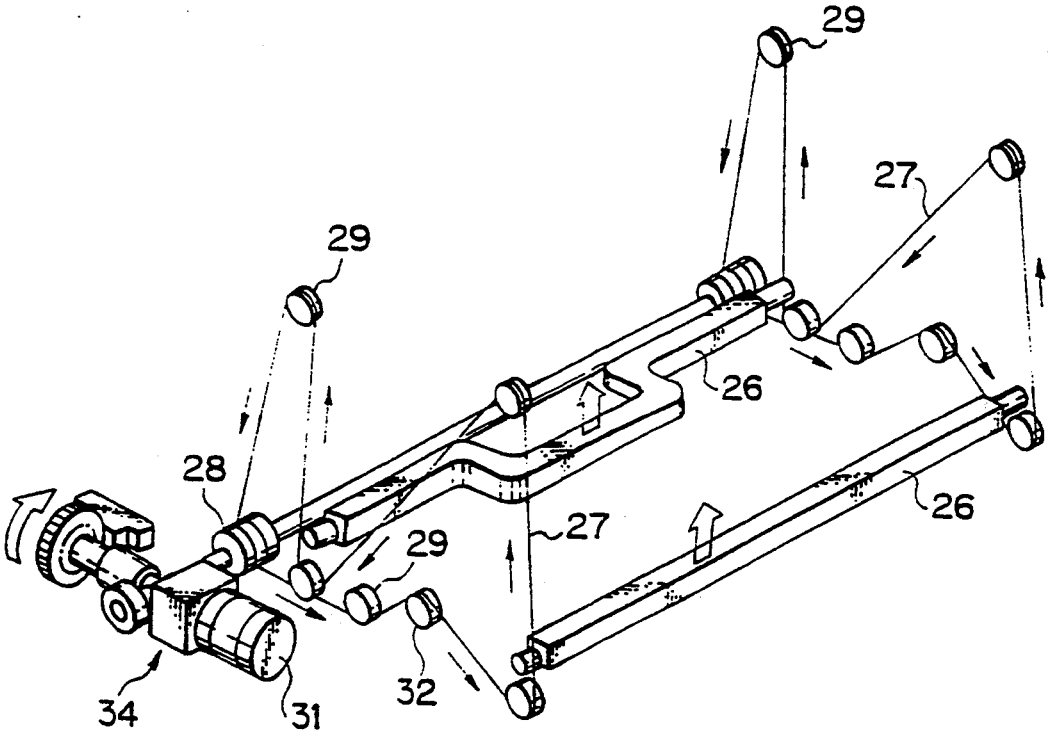
FIG. 7 is a perspective view showing an embodiment of a mechanism for raising an elevation plate.

Referring to FIGS. 4–10, a printer with a sheet feed device embodying the present invention will be described. In the illustrated embodiment, the same or similar constituents as those of the conventional sheet feed device 40 are designated by the same reference numerals, and a detailed description will not be made to avoid redundancy. As shown, a printer is made up of a print device 1 and a sheet feed device 2 disposed below and operatively connected to the print device 1. The sheet feed device 2 has a plurality of trays 4 disposed one above another, and a sheet feed mechanism, not shown. The trays 4 are accommodated in a table 3, and each may be pulled out in the front-and-rear direction. The sheet feed mechanism feeds sheets from any one of the trays 4 to the print device 1 one after another. As shown in FIG. 4, each tray 4 has a base 7. As shown in FIGS. 5 and 6 in detail, the base 7 is mounted on a guide bar 9 in such a manner as to be movable in the right-and-left direction. Specifically, the guide bar 9 is affixed to opposite side walls of a tray body 5 while extending between the side walls 22 of the base 7. The side walls 22 are each formed with a pair of vertical slots 23. Support rods 26 are each received in the slots 23 aligned with each other at opposite ends thereof.

An elevation plate 8 is laid on the support rods 26. A wire 27 is connected to one end of each support rod 26 while another wire 27 is connected to the other end of each support rod 26. The wires 27 each pass over rollers 28, 29 and 32 rotatably mounted on associated ones of the side walls 22. The roller 28 is mounted on a shaft 33 which is rotated by a motor 31 via a gearing 34. The roller 32 is a tension roller.

Figure 9:
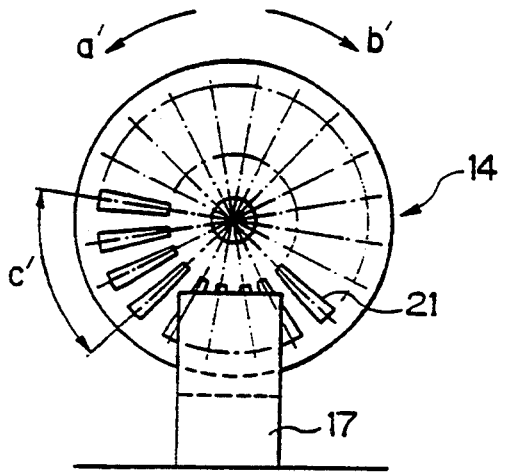
FIG. 9 is a front view of a slitted disk according to the invention.

The base 7 has a bottom plate 35 on which a motor 10 is mounted for moving the base 7 in the right-and-left direction. A ball screw 13 and a disk 14 are connected to the output shaft of the motor 10 by a joint 12. As shown in FIG. 9, the disk 14 is formed with a number of radial slots 21 at equally spaced locations along the circumference. A bracket 15 is affixed to the bottom of the tray body 5 in an upright position and held in threaded engagement with the ball screw 13. A slit sensor 17 is mounted on the upper surface of the bottom plate 35 to face the disk 14. A home position plate 18 is mounted on the lower surface of the bottom plate 35. Further, a home position sensor 19 is located on the bottom of the tray body 5 for sensing the home position plate 18. Connectors, not shown, are associated with the table 3 and each tray 4 such that when the tray 4 is set in the table 3, the connectors are coupled to feed a current to the motors 10 and 31 from a power source (not shown) while, when the tray 4 is pulled out of the table 3, they are uncoupled.

Figure 10:
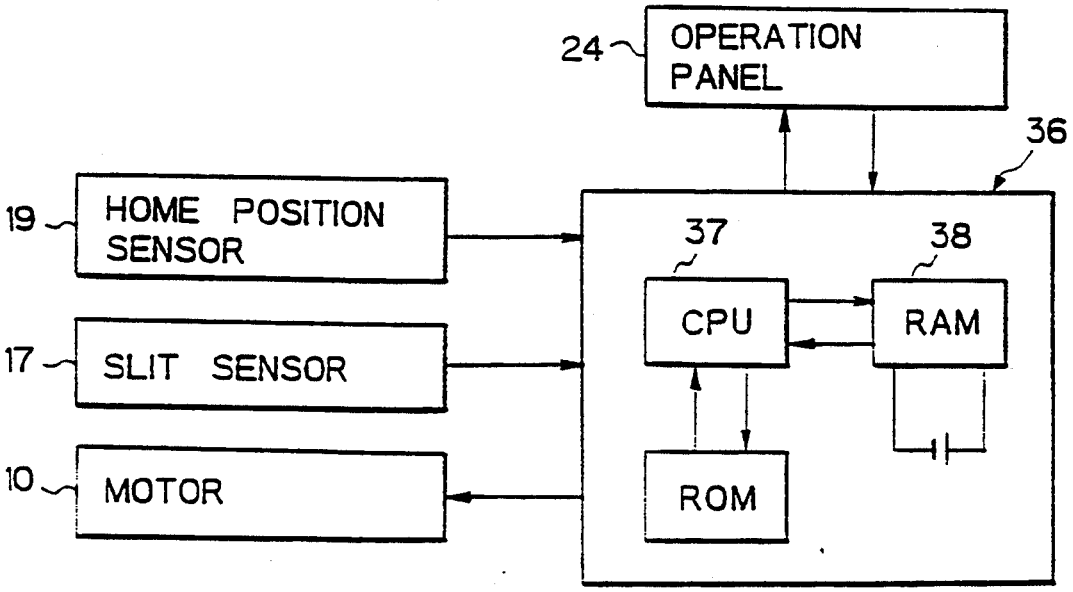
FIG. 10 is a block diagram schematically showing control means according to the invention.

The printer having the above construction is operated as follows. The operator pulls out desired one of the trays 4 from the table 3, stacks the sheets 30 on the elevation plate 8, and then presses a start key provided on an operation panel 25 (FIG. 10). Then, the motor 31 is energized to move the wires 27 in a direction indicated by arrows in FIG. 7. As a result, the support rods 26 are raised along the slots 23 of the base 7 while carrying the elevation plate 8 therewith. As the top of the sheet stack 30 abuts against a pick-up roller 41 with an adequate pressure, the elevation plate 8 is brought to a stop when a feeler (not show) senses the top sheet of the paper stack. In this condition, the pick-up roller 41 feeds the sheets 30 while a separating section 2 separates one of the sheets 30 from the others. A transport roller 43 transports the separated sheet 30 to a register roller 45 over the transport path 44. The register roller 45 first stops the movement of the sheet 30 and then drives it to a print drum 46 at a predetermined timing. A cut stencil is wrapped around the print drum 46. As a pressure roller 47 presses the sheet 30 against the drum 46 via the stencil, an image is transferred from the stencil to the sheet 30. A suction unit 48 separates the sheet 30 with the image from the print drum 46 and then discharges the sheet 30 onto a tray 49 while stressing it for a positioning purpose.

Assuming that the sheet 30 is deviated from the image cut in the stencil in the right-and-left direction while printing is under way, the base 7 is moved in the right-and-left direction relative to the tray 4 so as to correct the deviation, as follows. The operator observes a deviation of the image from an expected or desired position and decides upon a correction value, i.e., a value of a right or left movement of the image position, to correct the deviation. The operation panel 24 has an operation key (not shown) which, upon actuation of the key, is effective to move the image to the right or left by a designated amount by outputting a command of movement. The operator operates on the key to produce the correction values and, if necessary, refines the correction value until the deviation is eliminated. The command of the movement is inputted to the control section 36 in shown FIG. 10. The motor 10 is operated by the control section based on a program which is installed in the control section beforehand. The motor 10 rotates the ball screw 13 to thereby move the base 7 via the bracket 15 in the right-and-left direction. At this time, the disk 14 is rotated in synchronism with the drum 10. The slit sensor 17 counts the slits 21 of the disk 14 from the origin, whereby the displacement of the base 7 is measured.

Figure 8:
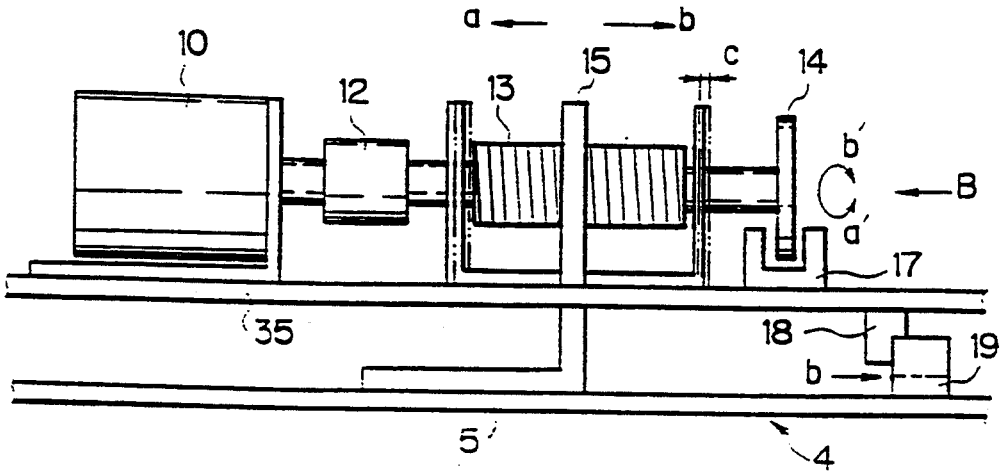
FIG. 8 is a fragmentary enlarged view of the tray shown in FIGS. 5 and 6.

Here, the play and backlash of the threaded portion of the ball screw 13 is a problem. Specifically, as shown in FIG. 8, the backlash causes a play "c" to occur between the base 7 and the bracket 15. As a result, when the direction of movement is switched from "a'" to "b'" or from "b'" to "a'", a difference or error corresponding to an amount "c'" (FIG. 9) occurs between the displacement of the base 7 sensed by the slit sensor 17 and the actual displacement.

In the illustrated embodiment, the error c is determined beforehand by, for example, experiments and set at a correction value. FIG. 10 schematically shows control means which corrects the displacement by using the correction value "c" when the direction of movement is switched over, thereby reducing the error. When the power source is switched on, the control section 36 causes the base 7 to move in the direction "a" to a position where the home position sensor 19 does not sense the home position plate 18. Thereafter, the control section 36 causes the base 7 to move in the direction "b" until the home position sensor 19 senses the home position plate 18 and stops it there. The movement in the direction "b" is written to a RAM 38 included in the control section 36.

In the above condition, assume that the operator manipulates the operation panel 24 to enter the direction "a" in which the base 7 should be moved, and a displacement "x". Then, a CPU 37 included in the control section 36 compares the direction data "a" entered in the panel 24 with the direction data "b" stored in the RAM 38. In this case, since the direction "a" is opposite to the direction "b", the actual displacement will be short of the displacement "x" entered on the panel 24. Hence, the CPU 37 adds the correction value "c" to the displacement "x" and then delivers a corresponding command to the motor 10. At the same time, the CPU 37 changes the content of the RAM 38 to the direction "a". Regarding the disk 14, the sum of a number "x'" of slits 21 corresponds to the displacement "x", and the correction value "c'" is also expressed in slits.

If the direction data entered in the panel 24 is identical with the direction data "b" stored in the RAM 38, no correction is executed, and the direction data "b" is maintained.

As stated above, the embodiment is capable of reducing an error in the displacement ascribable to the switchover of the direction without resorting to an extra mechanism. Since the RAM 38 is backed up by a battery, the direction data previously entered on the operation panel 24 is not deleted even when the power source is switched off.

In a further embodiment, assume that the key for displacement in the right-and-left direction (not shown) provided on the operation panel 24 is switched on and the command of the movement in the right-and-left direction is outputted from the operation panel 24 while sheet feeding is under way. The command of movement is inputted to the control section 36 and the movement of feeding the next sheet 30 by the pick-up roller 41 is first stopped. Thereafter, the base 7 is displaced in the right-and-left direction while a previous sheet or sheets 30 on the transport path 44 are transported and no sheet 30 remains on the transport path 44, and the movement of feeding the sheet 30 is restarted only after the displacement of the base 7 is finished.

If no sheet 30 exists on the transport path 44, the elevation plate 8 is immediately moved downward (or the roller 41 is raised by means which are not shown) until the stack detaches from the pick-up roller 41 and then the base 7 is displaced in the right-and-left direction. After the displacement of the base 7 is finished, the elevation plate 8 is raised (or the roller 41 lowered) until the top sheet 30 abuts against the pick-up roller 41. Thereafter, the movement of feeding the sheets 30 is restarted.

Alternatively, the pick-up roller 41 is not separated from the stack and the right- and -left direction displacement of the base 7 is performed while the rotation of the pick-up roller 41 is stopped. Since no sheets are being fed at this time, there is no danger of sheets being skewed, torn or wrinkled by the left and right displacement despite the fact that the pick-up roller remains in contact with the top sheet of the stack.

Alternatively, a message or an indication so as not to enter the demand of the displacement in the right-and-left direction may be displayed to the operator on the operation panel 24.

As stated above, the embodiment is capable of preventing sheet skew, sheet tearing and sheet wrinkling during feeding the sheet during the displacement of the base.

In summary, the present invention provides a sheet feed device which, when a sheet is deviated from an image cut in a stencil in the right-and-left direction, automatically moves a base to correct a sheet feed position. This eliminates the need for troublesome manual operations and positioning relying on eyesight, thereby enhancing rapid and accurate positioning. In addition, the device is not bulky and, therefore, requires a minimum of space for installation. Moreover, the device of the invention reduces errors in displacement ascribable to the switchover of a direction of movement without resorting to an extra mechanism. Furthermore, the device of the invention is capable of preventing sheet skew, sheet tearing and sheet wrinkling due to feeding the sheet during the displacement of the base.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A sheet feed device for feeding a sheet to an image recorder which records an image on said sheet, comprising:

a table disposed below and operatively connected to the image recorder;

a plurality of trays, each of said trays being received in said table and capable of being loaded with a stack of sheets, said trays each comprising a base and an elevation plate mounted on said base for vertical movement;

a sheet feed mechanism for feeding the sheets from any one of said plurality of trays to the image recorder; and moving means associated with each of said plurality of trays for moving said base in predetermined directions over predetermined displacements within the tray, wherein said predetermined directions comprise a sheet feed direction in which the sheets are fed from any one of said plurality of trays, and a direction perpendicular to said sheet feed direction and having two directional senses, including a sensor for sensing the displacement of said base in the perpendicular direction, and control means for correcting an error in the displacement of said base occurring when a directional sense of said perpendicular direction is changed.

2. A sheet feed device for feeding a sheet to an image recorder which records an image on said sheet, comprising:

a tray which may be loaded with a stack of sheets, said tray comprising a base and an elevation plate;

a sheet feed mechanism for feeding sheets in a sheet feed direction from said tray to the image recorder;

moving means for moving said base in a direction perpendicular to said sheet feed direction;

operation means for storing a deviation value for said moving means; and control means for controlling said moving means and being responsive to said deviation value.

3. A sheet feed device as claimed in claim 2, wherein said deviation value is due to play in said moving means.

4. A device as claimed in claim 2, in combination with said image recorder, wherein said image recorder comprises a printer using a stencil.

5. A device as claimed in claim 2, including a sensor for sensing the displacement of said base in said perpendicular direction.

6. A device as claimed in claim 5, wherein said control means includes means for correcting an error in the displacement of said base occurring when a directional sense of said perpendicular direction is changed.

7. A device as claimed in claim 2, wherein said base is disposed in the tray and said elevation plate is mounted for vertical movement on the base.

8. A device as claimed in claim 2, including a pick-up roller and a transport path on which fed sheets are transported to the image recorder, wherein said control means comprises means for first stopping sheet feeding when a command of movement in the perpendicular direction is outputted from said operation means, for subsequently displacing said base in said perpendicular direction after any sheet on the transport path is transported, and for restarting sheet feeding after the displacement of said base is finished.

9. A device as claimed in claim 2, including a pick-up roller and a transport path on which fed sheets are transported to the image recorder, wherein said control means comprises means for first stopping sheet feeding when a command of a movement in the perpendicular direction is outputted from said operation means after any sheet on the transport path is transported, for subsequently moving the elevation plate downward until a top sheet thereon detaches from the pick-up roller, for then displacing the base in said perpendicular direction, after the displacement of the base is finished, for raising the elevation plate until the top sheet abuts against said pick-up roller, and for subsequently restarting sheet feeding.

10. A devices as claimed in claim 2, including a pick-up roller and a transport path on which fed sheets are transported to the image recorder, wherein said control means comprises means for controlling said moving means during sheet feeding such that said base is displaced in said perpendicular direction only when said pick-up roller is not in operation.

11. A device as claimed in claim 2, further comprising a display for displaying a message or an indication not to enter a demand of displacement in the perpendicular direction during feeding of a sheet.

* * * * *

UNITED STATES PATENT AND TRADEMARK OFFICE

CERTIFICATE OF CORRECTION

PATENT NO. : 5,379,995

DATED : January 10, 1995

INVENTOR(S) : Kenji ENDO

It is certified that error appears in the above-indentified patent and that said Letters Patent is hereby corrected as shown below:

In Column 1, Lines 5-7, the Related U.S. Application Data is listed incorrectly. It should read:

--The present application is a continuation-in-part of U.S. patent application Ser. No. 07/998,686, filed Dec. 30, 1992, now abandoned.--

Signed and Sealed this

Sixteenth Day of May, 1995

Bruce Lehman

*Attest:*

BRUCE LEHMAN

*Attesting Officer*

*Commissioner of Patents and Trademarks*